US011339685B2

(12) United States Patent
Onishi et al.

(10) Patent No.: US 11,339,685 B2
(45) Date of Patent: May 24, 2022

(54) TURBINE CASING AND STEAM TURBINE

(71) Applicant: Mitsubishi Power, Ltd., Yokohama (JP)

(72) Inventors: Tomoyuki Onishi, Tokyo (JP); Katsuhisa Hamada, Yokohama (JP)

(73) Assignee: MITSUBISHI POWER, LTD., Yokohama (JP)

( * ) Notice: Subject to any disclaimer, the term of this patent is extended or adjusted under 35 U.S.C. 154(b) by 0 days.

(21) Appl. No.: 17/273,797

(22) PCT Filed: Jan. 20, 2020

(86) PCT No.: PCT/JP2020/001668
§ 371 (c)(1),
(2) Date: Mar. 5, 2021

(87) PCT Pub. No.: WO2020/170673
PCT Pub. Date: Aug. 27, 2020

(65) Prior Publication Data

US 2021/0199023 A1 Jul. 1, 2021

(30) Foreign Application Priority Data

Feb. 22, 2019 (JP) ..... JP2019-030959

(51) Int. Cl.
*F01D 25/24* (2006.01)
*F01D 25/28* (2006.01)

(52) U.S. Cl.
CPC ..... *F01D 25/243* (2013.01); *F01D 25/28* (2013.01); *F05D 2220/31* (2013.01); *F05D 2240/14* (2013.01); *F05D 2260/31* (2013.01)

(58) Field of Classification Search
CPC ..... F01D 25/28; F01D 25/243; F01D 25/246; F01D 25/24; F05D 2230/31; F05D 2260/31
See application file for complete search history.

(56) References Cited

U.S. PATENT DOCUMENTS 4,866,941 A 9/1989 Stock
5,466,122 A * 11/1995 Charbonnel ..... F01D 17/162 415/139
2014/0000258 A1* 1/2014 Nishimoto ..... F01K 21/00 60/643

FOREIGN PATENT DOCUMENTS

GB 1514834 A 6/1978
JP S51-091407 A 8/1976
(Continued)

OTHER PUBLICATIONS

Izumi et al., "Latest Stream Turbine Technologies for Thermal Power Plants", Fuji Electirc Review, 2013, vol. 86, No. 2, pp. 107-112, with English translation. (13 pages).
(Continued)

*Primary Examiner* — David E Sosnowski
*Assistant Examiner* — Maxime M Adjagbe
(74) *Attorney, Agent, or Firm* — WHDA, LLP

(57) ABSTRACT

A turbine casing comprises: a turbine casing body, which covers a rotor of a steam turbine from the outer side, and in which is formed an exhaust port through which steam is horizontally exhausted; an overhanging part that horizontally widens from the outer surface of the turbine casing body; and a support part that supports the overhanging part on a baseplate; the support part restraining vertical displacement of the overhanging part relative to the baseplate, and securing the overhanging part to the baseplate so as to allow the overhanging part to be horizontally deformed or displaced.

6 Claims, 3 Drawing Sheets

(56) References Cited

FOREIGN PATENT DOCUMENTS

| | | | |
|---|---|---|---|
| JP | S54-118949 | A | 9/1979 |
| JP | H02-64207 | A | 3/1990 |
| JP | H04-045303 | A | 2/1992 |
| JP | H04-295106 | A | 10/1992 |
| JP | H10-331306 | A | 12/1998 |
| JP | 2010-223146 | A | 10/2010 |
| JP | 2015-124634 | A | 7/2015 |
| JP | 2016-138484 | A | 8/2016 |
| JP | 2016-151263 | A | 8/2016 |
| JP | 2018-66303 | A | 4/2018 |

OTHER PUBLICATIONS

International Search Report dated Mar. 24, 2020, issued in counterpart International application No. PCT/JP2020/001668, with English translation. (6 pages).
Written Opinion dated Mar. 24, 2020, issued in counterpart International application No. PCT/JP2020/001668, with English translation. (9 pages).

* cited by examiner

TURBINE CASING AND STEAM TURBINE

Priority is claimed on Japanese Patent Application No. 2019-030959, filed on Feb. 22, 2019, the content of which is incorporated herein by reference.

TECHNICAL FIELD

The present invention relates to a turbine casing and a steam turbine.

BACKGROUND ART

A steam turbine includes a rotor extending along an axis and capable of rotating around the axis, and a casing (turbine casing) that covers the rotor from an outer peripheral side. A suction port for guiding high-temperature and high-pressure steam supplied from a boiler is formed on one side (upstream side) of the turbine casing in an axial direction. The steam guided from the suction port into the turbine casing alternately collides with a rotor blade provided on an outer peripheral surface of the rotor and a stator blade provided on an inner peripheral surface of the turbine casing, thereby applying a rotational force to the rotor. Thereafter, the steam is fed to an external condenser from an exhaust port formed on the other side (downstream side) of the turbine casing in the axial direction.

Up to now, it is a general knowledge that the exhaust port extends downward of the turbine casing. However, in order to mainly achieve space saving, a configuration has been practically adopted in which the exhaust port is formed either on a left side surface or a right side surface of the turbine casing (for example, refer to PTL 1 below). A low-pressure turbine casing has a cylindrical shape formed around the axis of the rotor. The exhaust port for exhausting the steam outward is formed in the low-pressure turbine casing in a radial direction (horizontal direction) of the axis. In addition, the low-pressure turbine casing is configured to include two members such as an upper-half portion on an upper side and a lower-half portion on a lower side. In general, only the lower-half portion is fixed to a floor surface (base plate) by an anchor. That is, the upper-half portion is not fixed to the floor surface.

CITATION LIST

Patent Literature

[PTL 1] Japanese Unexamined Patent Application Publication No. 2018-066303

SUMMARY OF INVENTION

Technical Problem

Here, the low-pressure turbine casing is internally in a vacuum state in order to promote smooth exhaust. That is, the low-pressure turbine casing receives a load generated from an outside by atmospheric pressure. On the other hand, the exhaust port of the low-pressure turbine casing is open to the atmospheric pressure. Accordingly, a load acting toward the exhaust port side in the horizontal direction is generated in the low-pressure turbine casing. Due to the load, a moment around the axis is generated in the upper-half portion. In this manner, the upper-half portion may be displaced to deform upward in some cases. The displacement causes vibrations in the turbine casing. On the other hand, due to heat of the steam, thermal expansion occurs in the turbine casing. Accordingly, it is not a best way to completely suppress the displacement of the upper-half portion. Therefore, there is an increasing demand for the turbine casing having a structure capable of suppressing upward deformation while allowing thermal expansion.

The present invention is made to solve the above-described problem, and an object thereof is to provide a turbine casing capable of suppressing upward deformation while allowing thermal expansion, and a steam turbine including the same.

Solution to Problem

According to an aspect of the present invention, there is provided a turbine casing including a turbine casing body that covers a rotor of a steam turbine from an outside and has an exhaust port for exhausting steam in a horizontal direction, an extension portion that extends in the horizontal direction from an outer surface of the turbine casing body, and a support portion that supports the extension portion on a base plate. The support portion restricts displacement of the extension portion with respect to the base plate in a vertical direction, and fixes the extension portion to the base plate in a state where deformation or the displacement of the extension portion is allowed in the horizontal direction.

Here, the turbine casing body is internally in a vacuum state in order to promote smooth exhaust of the steam. That is, the turbine casing body receives a load generated from an outside by atmospheric pressure. On the other hand, the exhaust port of the turbine casing body is open to the atmospheric pressure. Accordingly, a lead acting toward the exhaust port side in the horizontal direction is generated in the turbine casing body.

Due to the load, a moment around a central axis of the rotor is generated in an upper-half portion of the turbine casing body. As a result, the turbine casing body may be displaced to deform upward in some cases. The displacement causes vibrations in the turbine casing. Accordingly, it is desirable to suppress the displacement. On the other hand, due to heat of the steam, thermal expansion occurs in the turbine casing body and the extension portion. Therefore, it is not a best way to completely suppress the deformation or the displacement. Therefore, in the above-described configuration, the support portion restricts the displacement of the extension portion with respect to the base plate in the vertical direction, and fixes the extension portion to the base plate in a state where the deformation or the displacement is allowed in the horizontal direction. In this manner, it is possible to suppress the displacement (upward deformation) in the vertical direction while allowing the thermal expansion of the turbine casing body and the extension portion in the horizontal direction.

In the above-described turbine casing, the support portion may have a bolt inserted into a through-hole formed in the extension portion, having a threaded portion formed on an outer peripheral surface, and having a lower end portion meshing with a threaded hole formed in the base plate, a nut that fixes the extension portion to the base plate in the vertical direction by meshing with an upper end portion of the bolt, and a washer provided between the nut and the extension portion. A thickness of the washer may be smaller than a separation dimension between the nut and the extension portion.

According to the above-described configuration, the thickness of the washer is smaller than the separation dimension between the nut and the extension portion. In this manner, when the moment is applied to the turbine casing body in a state where the nut is attached to the bolt, the displacement or the thermal expansion in the vertical direction is allowed to some extent in the extension portion. On the other hand, the nut is provided. Accordingly, excessive displacement or thermal expansion in the vertical direction can be restricted. Therefore, for example, compared to a configuration in which the displacement or the deformation of the extension portion in the vertical direction is completely suppressed, the extension portion can be supported on the base plate while stress generated in the extension portion and the turbine casing body is released to some extent.

In the above-described turbine easing, an inner diameter dimension of the through-hole may be larger than an outer diameter dimension of the bolt.

According to the above-described configuration, the inner diameter dimension of the through-hole is larger than the outer diameter dimension of the bolt. Accordingly, when the moment is generated in the extension portion, the bolt can move inside the through-hole to some extent in the horizontal direction. On the other hand, excessive displacement of the bolt is restricted by the through-hole. Therefore, for example, compared to a configuration in which the displacement or the deformation of the extension portion in the horizontal direction is completely suppressed, the extension portion can be supported on the base plate while the stress generated in the extension portion and the turbine casing body is released to some extent.

The above-described turbine casing may further have a low friction member provided on a surface of the washer on an extension portion side and having a friction coefficient lower than a friction coefficient between the washer and the extension portion.

According to the above-described, configuration, the low friction member is provided between the washer and the extension portion. Accordingly, a frictional force generated between the washer and the extension portion is reduced when the extension portion is displaced in the horizontal direction. In this manner, a load applied to the extension portion can be reduced.

In the above-described turbine casing, the support portion may have a base portion disposed on the base plate with a gap from the extension portion in the horizontal direction, and a pressing portion that extends in the horizontal direction from an upper surface of the base portion and has a facing surface which faces an upper surface of the extension portion with a gap.

According to the above-described configuration, the base portion can restrict excessive displacement or excessive deformation while the displacement or the deformation of the extension portion is allowed to some extent in the horizontal direction. In addition, the pressing portion can restrict excessive displacement or excessive deformation while allowing the displacement or the deformation of the extension portion to some extent in the vertical direction. Therefore, for example, compared to a configuration in which the displacement or the deformation of the extension portion in the vertical direction is completely suppressed, the extension portion can toe supported on the base plate while stress generated in the extension portion and the turbine casing body is released to some extent.

According to an aspect of the present invention, there is provided a steam turbine including a rotor rotatable around an axis, and the turbine casing according to any one of the above-described aspects, which covers the rotor from an outside.

According to the above-described configuration, it is possible to provide the steam turbine which can be more stably operated by suppressing the displacement or the deformation of the turbine casing.

Advantageous Effects of Invention

According to the present invention, it is possible to provide a turbine casing capable of suppressing upward deformation while allowing thermal expansion, and a steam turbine including the same.

DESCRIPTION OF EMBODIMENTS

First Embodiment

Figure 1:
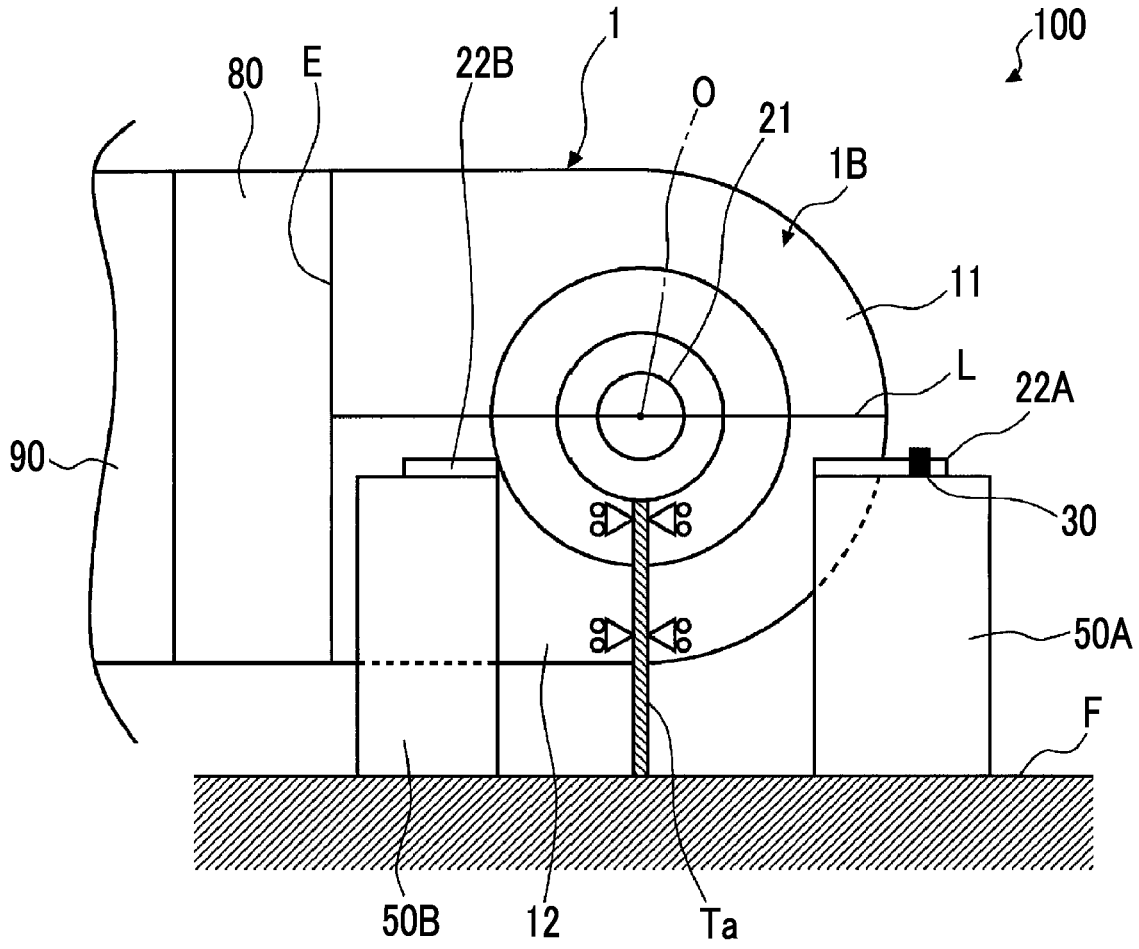
FIG. 1 is a side view illustrating a configuration of a steam turbine according to a first embodiment of the present invention.
Figure 2:
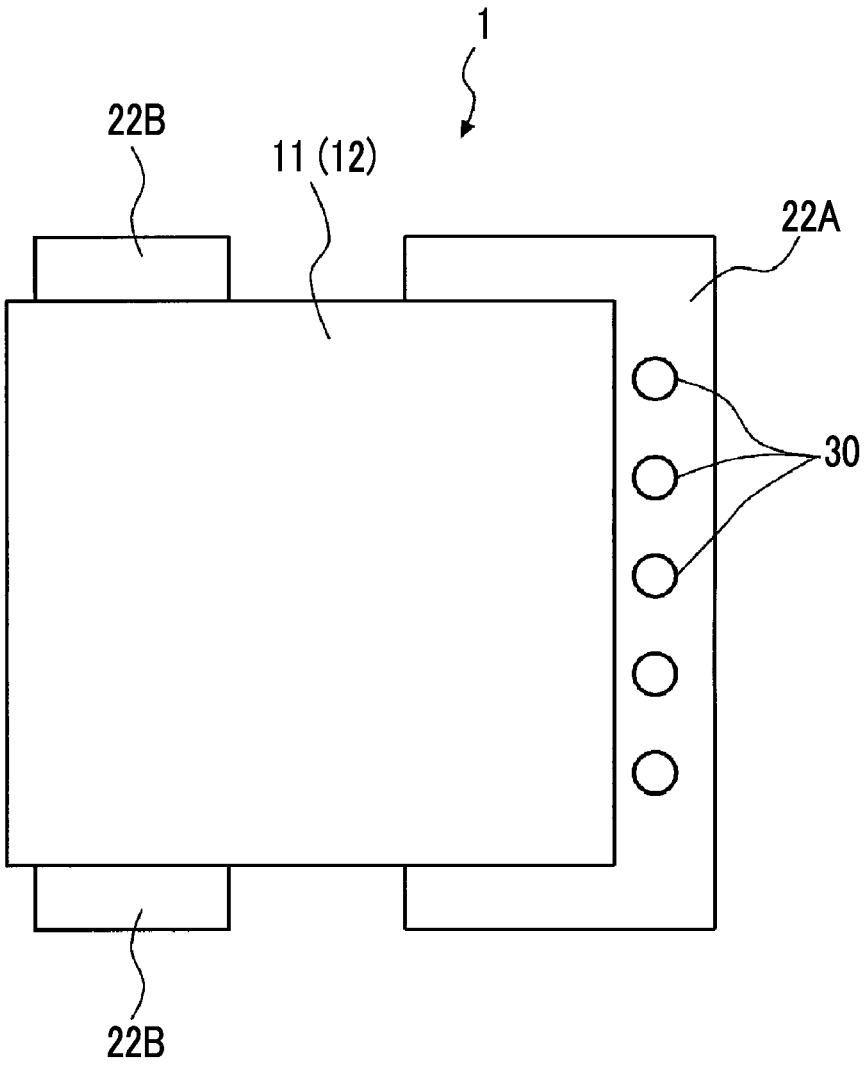
FIG. 2 is a plan view of a turbine casing according to the first embodiment of the present invention.

A first embodiment of the present invention will be described with reference to FIGS. 1 to 3. As illustrated in FIG. 1, a steam turbine 100 according to the present embodiment includes a rotor 21 rotatable around an axis O extending in a horizontal direction, and a turbine casing 1 that covers the rotor 21 from an outer peripheral side. Although not illustrated in detail, the rotor 21 extends along the axis O, and a plurality of rotor blade rows are provided on an outer peripheral surface thereof at an interval in a direction of the axis O. An inner peripheral surface of the turbine casing 1 has a plurality of stator blade rows alternately arrayed in the direction of the axis O with respect to the plurality of rotor blade rows. High-temperature and high-pressure steam guided into the turbine casing 1 alternately collides with the rotor blade rows and the stator blade rows, thereby rotating the rotor 21 inside the turbine casing 1.

The turbine casing 1 has a cylindrical turbine casing body 1B formed around the axis O, a first extension portion 22A (extension portion) provided on an outer surface of the turbine casing body 1B, and a second extension portion 22B. The turbine casing body 1B has an upper half turbine casing 11 located on the upper side and a lower half turbine casing 12 located on the lower side, when a division surface L in the horizontal direction which passes through the axis O is set as a boundary. The upper half turbine casing 11 and the lower half turbine casing 12 respectively have a semi-cylindrical shape, and are integrally joined in an upward-downward direction via the division surface 1, thereby forming the turbine casing body 1B. A portion of the turbine casing 1 configured in this way is an exhaust port E which is open in the horizontal direction. The exhaust port E communicates with a condenser 90 via a connection portion 80. The condenser 90 is a device for liquefying low-temperature and low-pressure steam exhausted from the exhaust port E.

The lower half turbine casing 12 has a first extension portion 22A and a second extension portion 22B for fixing the lower half turbine casing 12 to a first foundation portion 50A installed on a floor surface F and a second foundation portion 50B, and a transverse anchor Ta. The first extension portion 22A is fixed to an upper surface of the first foundation portion 50A extending upward from the floor surface F by a support portion 30 (to be described later). The first extension portion 22A has a plate shape extending in the horizontal direction from an outer surface of the turbine casing body 1B (lower half turbine casing 12) (refer to FIG. 2). When viewed from above, the first extension portion 22A has a C-shape to surround the lower half turbine casing 12.

The second extension portion 22B is not fixed to and placed on an upper surface of the second foundation portion 50B extending upward from the floor surface. The second extension portion 22B has a plate shape extending in the horizontal direction from an outer surface of the turbine casing body 1B (lower half turbine casing 12) (refer to FIG. 2). The second extension portion 22B is provided at a position away from the first extension portion 22A in the horizontal direction. In addition, the second extension portions 22B are provided one by one on both sides in the direction of the axis O.

The transverse anchor Ta is at fixing device that restricts the displacement of the lower half turbine casing 12 in the horizontal direction and allows the displacement or the deformation in the vertical direction. When viewed in the direction of the axis O, the transverse anchor Ta is provided at a position overlapping the axis O of the lower half turbine casing 12.

The support portion 30 fixes the first extension portion 22A in a state where the displacement in the vertical direction is restricted on the first foundation portion 50A and the deformation or the displacement is allowed in the horizontal direction. As illustrated in FIG. 2, a plurality of the support portions 30 are provided at an interval in the direction of the axis O.

Figure 3:
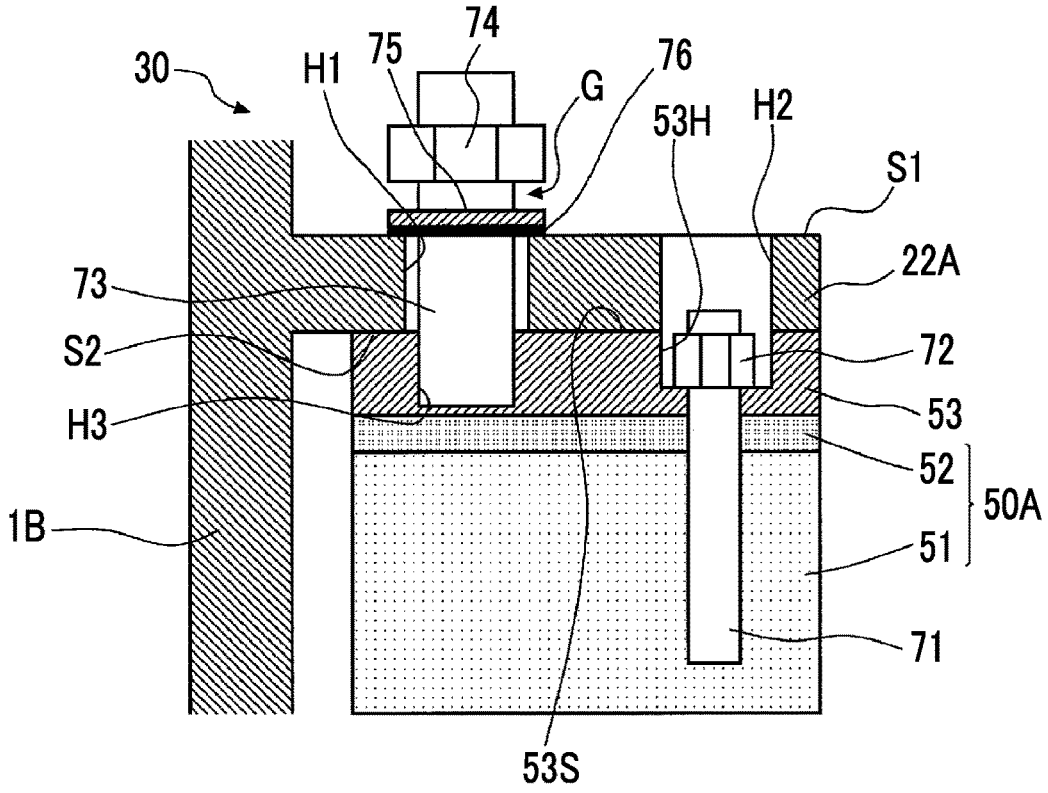
FIG. 3 is a sectional view illustrating a configuration of a support portion according to the first embodiment of the present invention.

As illustrated in FIG. 3, the first foundation portion 50A has a foundation body 51 formed of reinforced concrete, and a grout 52 integrally provided on an upper surface of the foundation body 51. Furthermore, a base plate 53 made of metal is attached to an upper surface of the grout 52. The base plate 53 has a base plate hole 53H recessed in a thickness direction (vertical direction) from an upper surface (base plate upper surface 53S) of the base plate 53. A foundation bolt 71 is inserted into the base plate hole 53H.

A foundation nut 72 that fixes and presses the base plate 53 to the upper surface of the grout 52 is fastened to an upper end of the foundation bolt 71. A second hole H2 having a size into which the foundation bolt 71 can be inserted is formed at a position corresponding to the base plate hole 53H in the first extension portion 22A. That is, the foundation bolt 71 can be attached after the first extension portion 22A is disposed on the first foundation portion 50A.

The support portion 30 has a bolt 73, a nut 74, a washer 75, and a low friction member 76. The bolt 73 is inserted into a first hole H1 (through-hole) formed in the first extension portion 22A. The first hole H1 is formed at a position closer to the turbine casing body 1B (lower half turbine casing 12) than the above-described second hole H2. An inner diameter dimension of the first hole H1 is larger than an outer diameter dimension of the bolt 73. That is, a gap is formed between an outer peripheral surface of the bolt 73 and an inner peripheral surface of the first hole H1. A lower end portion of the bolt 73 is fixed by meshing with a threaded hole H3 formed in the base plate 53.

The nut 74 is attached to an upper end of the bolt 73. The nut 74 is fastened at a position separated upward from an upper surface S1 of the first extension portion 22A. That is, a gap G is formed between the nut 74 and the upper surface S1. The washer 75 is attached to this gap G. The washer 75 has an annular shape having an inner diameter dimension into which the nut 74 can be inserted. A thickness of the washer 75 is smaller than a separation dimension (dimension of the gap G in the vertical direction) between the nut 74 and the first extension portion 22A.

The low friction member 76 is integrally attached below the washer 75. The low friction member 76 has a friction coefficient lower than a friction coefficient between the washer 75 and the first extension portion 22A. As an example, the low friction member 76 is formed of a resin material containing nylon or Teflon (registered trademark). According to the above-described configuration, a lower surface S2 of the first extension portion 22A and the base plate upper surface 53S are in a state of being in contact with each other.

Here, the turbine casing body 1B is internally in a vacuum state in order to promote smooth exhaust of the steam. That is, the turbine casing body 1B receives a load generated from an outside by atmospheric pressure. On the other hand, the exhaust port E of the turbine casing body 1B is open to the atmospheric pressure. Accordingly, a load acting toward the exhaust port E side in the horizontal direction is generated in the turbine casing body 1B. Due to the load, a moment around the central axis (axis O) of the rotor 21 is generated in an upper-half portion (upper half turbine casing 11) of the turbine casing body 1B. As a result, the upper half turbine casing 11 is pushed by the lower half turbine casing 12 from below. Accordingly, in some cases, the upper half turbine casing 11 may be displaced to deform upward. The displacement causes vibrations in the turbine casing body 1B. Accordingly, it is desirable to suppress the displacement. On the other hand, due to heat of the steam, thermal expansion occurs in the turbine casing body 1B and the first extension portion 22A. Therefore, it is not a best way to completely suppress the deformation or the displacement.

Therefore, in the above-described configuration, the support portion 30 fixes the first extension portion 22A to the base plate 53 in a state where the displacement of the first extension portion 22A with, respect, to the base plate 53 is restricted in the vertical direction and the deformation or the displacement is allowed in the horizontal direction. In this manner, the displacement (upward deformation) in the vertical direction can be suppressed while the thermal expansion in the horizontal direction is allowed in the turbine casing body 1B and the extension portion.

Specifically, according to the above-described configuration, the thickness of the washer 75 is smaller than the separation dimension between the nut 74 and the first extension portion 22A. In this manner, when a moment is applied to the turbine casing body 1B in a state where the nut 74 is attached to the bolt 73, the displacement or the thermal expansion in the vertical direction is allowed to some extent in the first extension portion 22A. On the other hand, the nut 74 is provided. Accordingly, excessive displacement or thermal expansion in the vertical direction can be restricted. Therefore, for example, compared to a configuration in which the displacement or the deformation of the first extension portion 22A in the vertical direction is completely suppressed, the first extension portion 22A can be supported on the base plate 53 while stress generated in the first extension portion 22A and the turbine casing body 1B is released to some extent.

Furthermore, according to the above-described configuration, the inner diameter dimension of the first hole H1 is larger than the outer diameter dimension of the bolt 73. Accordingly, when a moment is generated in the first extension portion 22A, the bolt 73 can move inside the first hole H1 to some extent in the horizontal direction. On the other hand, excessive displacement of the bolt 73 is restricted by the first hole H1. Therefore, for example, compared to a configuration in which the displacement or the deformation of the first extension portion 22A in the horizontal direction is completely suppressed, the first extension portion 22A can be supported on the base plate 53 while stress generated in the first extension portion 22A and the turbine casing body 1B is released to some extent.

In addition, according to the above-described configuration, the low friction member 76 is provided between the washer 75 and the first extension portion 22A. Accordingly, a frictional force generated between the washer 75 and the first extension portion 22A is reduced when the first extension portion 22A is displaced in the horizontal direction. In this manner, a stress load generated when the first extension portion 22A is displaced or deformed can be reduced.

Hitherto, the first embodiment of the present invention has been described. The above-described configurations can be changed or modified in various ways as long as the change or the modification does not depart from the concept of the present invention.

Second Embodiment

Figure 4:
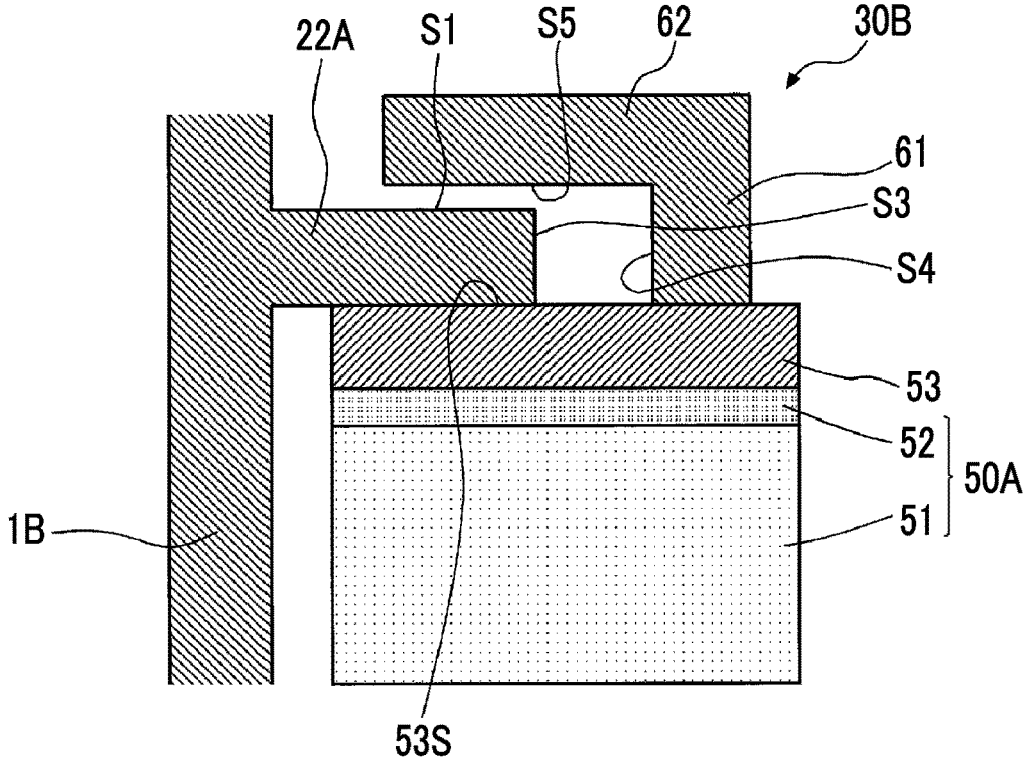
FIG. 4 is a sectional view illustrating a configuration of a support portion according to a second embodiment of the present invention.

Next, a second embodiment of the present invention will be described with reference to FIG. 4. The same reference numerals will be assigned to configurations the same as those in the first embodiment, and detailed description thereof will be omitted. As illustrated in FIG. 4, a support portion 30B according to the present, embodiment has an L-shape in a sectional view. The support portion 30B has a base portion 61 and a pressing portion 62.

The base portion 61 is fixed onto the base plate upper surface 53S, and has a plate shape extending upward.

A surface (base portion inner surface S4) facing the first extension portion 22A in the base portion 61 faces a surface (side surface S3) facing in the horizontal direction of the first extension portion 22A with a gap.

The pressing portion 62 extends in the horizontal direction from an upper end of the base portion 61 toward the first extension portion 22A side. A lower surface (facing surface S5) of the pressing portion 62 faces the upper surface S1 of the first extension portion 22A with a gap.

According to the above-described configuration, the base portion 61 faces the first extension portion 22A with a gap. Accordingly, excessive displacement or excessive deformation can be restricted while the displacement or the deformation of the first extension portion 22A is allowed to some extent in the horizontal direction. In addition, the pressing portion 62 faces the first extension portion 22A with a gap. Accordingly, excessive displacement or excessive deformation can be restricted while the displacement or the deformation of the first extension portion 22A is allowed to some extent in the vertical direction. Therefore, for example, compared to a configuration in which the displacement or the deformation of the first extension portion 22A in the vertical direction is completely suppressed, the extension portion can be supported on the base plate while stress generated in the first extension portion 22A and the turbine casing body 1B is released to some extent.

Hitherto, the second embodiment, of the present invention has been described. The above-described configurations can be changed or modified in various ways as long as the change or the modification does not depart from the concept of the present invention.

INDUSTRIAL APPLICABILITY

The present invention is applicable to a turbine casing and a steam turbine.

REFERENCE SIGNS LIST

100 steam turbine
1 turbine casing
1B turbine casing body
11 upper half turbine casing
12 lower half turbine casing
21 rotor
22A first extension portion (extension portion)
22B second extension portion
30 support portion
30B support portion
50A first foundation portion
50B second foundation portion
51 foundation body
52 grout
53 base plate
53H base plate hole
53S base plate upper surface
61 base portion
62 pressing portion
71 foundation bolt
72 foundation nut
73 bolt
74 nut
75 washer
76 low friction member
80 connection portion
90 condenser
F floor surface
G gap
H1 first hole (through-hole)
H2 second hole
H3 threaded hole
L division surface
O axis
S1 upper surface
S2 lower surface
S3 side surface
S4 base portion inner surface
S5 facing surface
Ta transverse anchor

The invention claimed is:

1. A turbine casing comprising:

a turbine casing body that covers a rotor of a steam turbine from an outside and has an exhaust port for exhausting steam in a horizontal direction;

an extension portion that extends in the horizontal direction from an outer surface of the turbine casing body;

a support portion that supports the extension portion on a base plate; and a foundation bolt inserted into a base plate hole formed in the base plate and a through-hole formed in a foundation portion, wherein the support portion restricts displacement of the extension portion with respect to the base plate in a vertical direction, and fixes the extension portion to the base plate in a state where deformation or the displacement of the extension portion is allowed in the horizontal direction, wherein the support portion has a bolt inserted into a first through-hole formed in the extension portion, having a threaded portion formed on an outer peripheral surface, and having a lower end portion meshing with a threaded hole formed in the base plate, a nut that fixes the extension portion to the base plate in the vertical direction by meshing with an upper end portion of the bolt, and a washer provided between the nut and the extension portion, a thickness of the washer is smaller than a separation dimension between the nut and the extension portion, and a foundation nut fastened to the foundation bolt has an outer diameter smaller than an inner diameter of the base plate hole and is in direct contact with a bottom part of the base plate hole to fix the base plate to the foundation portion.

2. The turbine casing according to claim 1, wherein an inner diameter dimension of the first through-hole is larger than an outer diameter dimension of the bolt.

3. The turbine casing according to claim 1, further comprising:

a low friction member provided on a surface of the washer on an extension portion side and having a friction coefficient lower than a friction coefficient between the washer and the extension portion.

4. A steam turbine comprising:

a rotor rotatable around an axis; and the turbine casing according to claim 1, which covers the rotor from outside.

5. The turbine casing according to claim 1, wherein the foundation bolt is inserted into the base plate hole and the through-hole formed in the foundation portion via a second through-hole formed in the extension portion.

6. The turbine casing according to claim 5, the first though-hole is formed at a position closer to the turbine casing body than the second through-hole in the extension portion.

* * * * *